US006196309B1

(12) United States Patent
Estilette, Sr.

(10) Patent No.: US 6,196,309 B1
(45) Date of Patent: Mar. 6, 2001

(54) DOWN HOLE PULLING TOOL AND METHOD OF USE

(76) Inventor: Felix F. Estilette, Sr., P.O. Box 39, Carencro, LA (US) 70520

( * ) Notice: Subject to any disclaimer, the term of this patent is extended or adjusted under 35 U.S.C. 154(b) by 0 days.

(21) Appl. No.: 09/209,583

(22) Filed: Dec. 11, 1998

(51) Int. Cl.[7] ..... E21B 31/12

(52) U.S. Cl. ..... 166/98; 166/99; 166/178; 166/301; 294/86.18; 294/86.3

(58) Field of Search ..... 166/301, 98, 99, 166/178; 294/86.18, 86.3, 86.31, 86.33, 86.29

(56) References Cited

U.S. PATENT DOCUMENTS

| | | | | |
|---|---|---|---|---|
| 2,508,285 | * | 5/1950 | Otis et al. | 294/86.18 |
| 2,605,131 | * | 7/1952 | Marshall et al. | 294/86.18 |
| 2,872,238 | * | 2/1959 | Daffin | 294/86.18 |
| 3,863,974 | * | 2/1975 | Dinning | 294/86.3 |
| 4,767,145 | * | 8/1988 | Bullard | 294/86.18 |

* cited by examiner

*Primary Examiner*—H. Shackelford

(74) *Attorney, Agent, or Firm*—Domingue & Waddell, PLC

(57) ABSTRACT

An apparatus for pulling objects from a well is described. The apparatus may comprise an elongated housing having an internal chamber. The housing will be connected to a work string such as wireline or coiled tubing. A skirt is attached to the housing, with the skirt having an inner portion. The skirt will contain a first window and a second window, with the first window having a first load shoulder and the second window having a second load shoulder. The apparatus further contains a mandrel disposed within the inner portion of the skirt, and two dog members disposed about the mandrel. The dog member have a first surface that cooperates with the first load shoulder and a second surface that cooperates with the second load shoulder. The dog members distributes a pull force which is exerted on the apparatus to the first and second load shoulder so that the effective tensional strength of the skirt is enhanced. The mandrel will have a second end containing an angled shoulder. The dog member will contain an angled leg that is configured to cooperate with the angled shoulder of the mandrel. The apparatus comprises a member for selectively disconnecting the skirt to the mandrel so that the mandrel is slidably received within the inner chamber of the housing which allows for the apparatus to be retrieved from the well. A method of releasing a device that is attached to an object within a well bore is also disclosed.

5 Claims, 5 Drawing Sheets

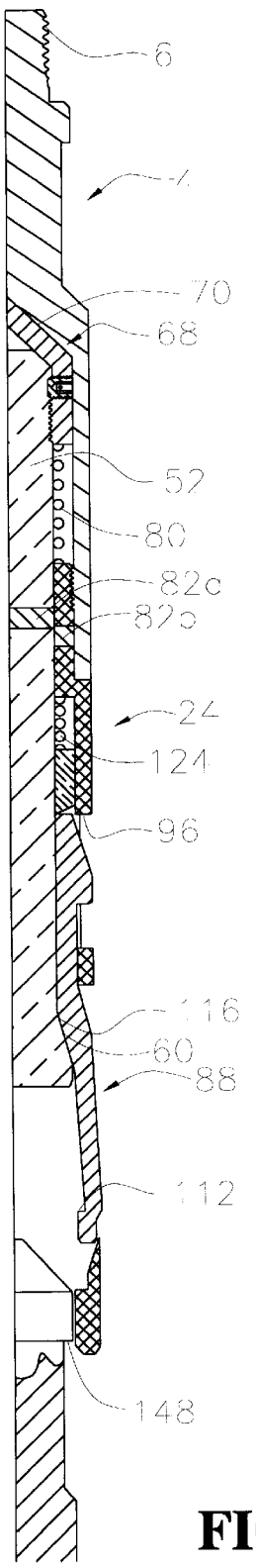
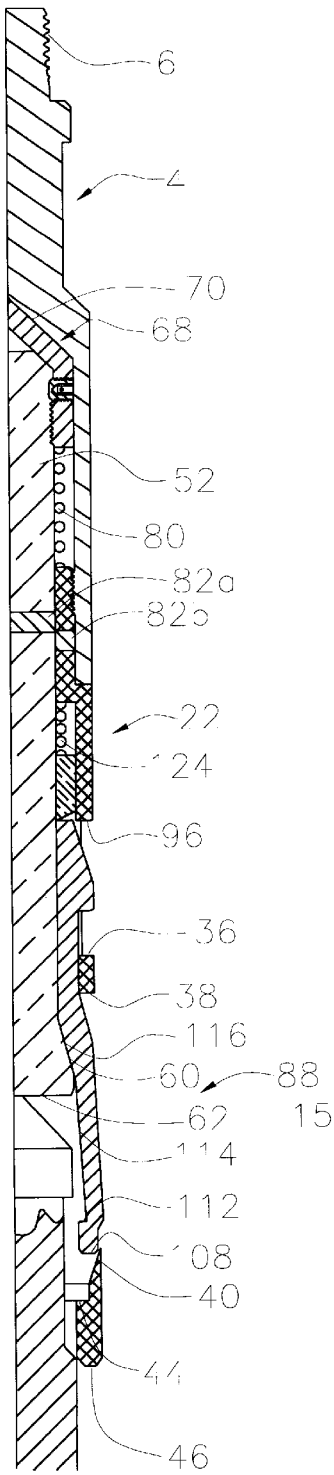
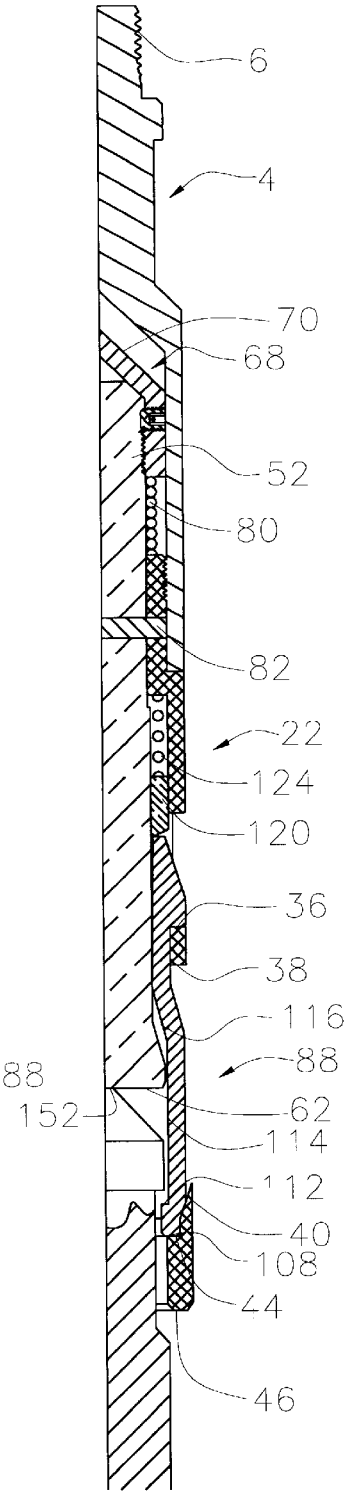
FIGURE 9
FIGURE 8
FIGURE 10

DOWN HOLE PULLING TOOL AND METHOD OF USE

BACKGROUND OF THE INVENTION

This invention relates to an apparatus and method for retrieving objects from a well bore. More particularly, but not by way of limitation, the invention relates to a pulling tool and method for retrieving objects that are located within a well.

In the oil and gas industry, a well will intersect a subterranean hydrocarbon reservoir. The well will be completed to the reservoir, and the hydrocarbons will be produced to the surface. During the drilling, completion, and production of the well, operators will many times find it necessary to set various tools within the well. As those of ordinary skill in the art will appreciate, various devices are run into the well, set into the well, and later retrieved from the well. In order to run tools into the well, running tools that are commercially available from various manufacturers such as Camco and Halliburton are used. The devices set into the well may include valves, plugs, safety devices, and other tools.

In the event that the tool previously placed into the well requires removal, the operator will run into the well with a pulling tool. The pulling tool is used to retrieve the previously set device within the well and is commercially available from Camco, Halliburton and others. Nevertheless, when an operator attempts to retrieve a device from a well, the device may be difficult to pull. As those of ordinary skill in the art will appreciate, the operator may latch onto an object and experience a high degree of difficulty with retrieving the object/device. Even during normal retrieval operation, significant demands are placed on the integrity and strength of a pulling tool.

Sometimes, the amount of force required to dislodge the object overcomes the structural integrity of the pulling tool. In other cases, the object being pulled becomes in effect stuck in the well. Therefore, pulling tools have been designed so that the tool will shear off of the object at a predetermined force.

Prior art tools have been limited in the amount of pull force that can be applied to the pulling tool. The pull force will be limited by the structural design of the pulling tool. Therefore, there is a need for a tool that will allow for a greater pulling force to be exerted. There is also a need for a pulling tool that will allow for a greater force to be exerted in highly deviated and horizontal wells.

SUMMARY OF THE INVENTION

An apparatus for pulling objects from a well is described. The apparatus may comprise an elongated housing having an internal chamber. The housing will have means for connecting to the work string. The work string may include wireline, tubular, and/or coiled tubing. In the preferred embodiment, the work string will be wireline. A skirt is attached to the housing, with the skirt having an inner portion. The skirt will contain a first window and a second window therein, with the first window having a first shoulder thereon and the second window having a second shoulder thereon.

The apparatus further contains a mandrel disposed within the inner portion of the skirt, and a dog member disposed after the mandrel. The dog member has a first surface that cooperates with the first shoulder and a second surface that cooperates with the second shoulder. The apparatus also contains means, disposed about the mandrel, for biasing the dog member in a downward direction. The mandrel will have a first end and a second end, with the second end containing an angled shoulder. The dog member will contain an angled leg that is configured to cooperate with the angled shoulder of the mandrel. In the preferred embodiment, two dog members are used. When two dog members are used, the skirt contains a third and fourth window with a third shoulder and a fourth shoulder respectively.

In one embodiment, the apparatus will further comprise means for connecting the skirt with the mandrel. The first end of the mandrel contains a core nut attached thereto, with the core nut cooperating with the internal chamber of the housing to form a first spring chamber. The apparatus further comprises a first spring disposed within the first spring chamber, with the first spring acting to create a force against the core nut in an upward direction. The connecting means includes a shear pin that attaches the skirt to the mandrel such that as the shear pin is sheared, the mandrel is slidably received within the inner chamber of the housing. The biasing means may further comprise a spring, and a retaining ring disposed about the mandrel and cooperating with the spring to urge the dog member into engagement with the first shoulder and the second shoulder. Also, the mandrel may contain an inner bore, and the device may further include seal means, disposed about the mandrel, for sealing a fluid in the inner bore from the first spring chamber.

The device may be attached to a work string. The device comprises a tubular housing, a skirt attached to the tubular housing, the skirt containing a first and second window with shoulders thereon, a core being disposed within an inner bore of the skirt, with the core containing an end having an angled shoulder, a dog member disposed about the core, the dog member having a first end that cooperates with the first window and a second end that cooperates with the second window.

The method includes pulling upward on the wire line so that an upward force is created, and transferring the upward force to the tubular housing. Next, the upward force is transferred to the first window and the second window. The dogs are supported at the first shoulder of the first window and at the second shoulder of the second window. This allows distribution of the upward force to two points in the skirt. The operator may then provide a downward jarring force to the tubular housing. The core is contacted against the object, and a pin may be sheared so that the core is slidably disposed within the inner portion of the tubular housing. A core spring, located in a first spring chamber, is expanded which in turn lifts the core upward.

Next, the angled core end is engaged with an angled surface of the dog member which in turn lifts the dog member thereby expanding the dog member outward into the first window. The core is biased with the core spring located within the spring chamber. Thereafter, the core is moved upward within the inner portion. Next, the device is sheared and released from the object, and the device can be retrieved from the well bore.

An advantage of the present invention is the novel dog, support herein disclosed. Another advantage is the that the dogs are supported at two points in the skirt. Dogs in the prior art are supported at only one point in the skirt. Still yet another advantage is that the upward pull force is distributed to the skirt in two different locations.

A feature of the present invention is the use of a first and second dog member in the preferred embodiment that are extra wide so that approximately 50% of the fishing neck circumferential area is covered. Another feature is the ability to have a jar-up embodiment and a jar-down embodiment with essentially identical components. Also, in cases where it is not recommended to run a "jar down to shear" pulling tool, the operator has the ability to run the "jar-up to shear" pulling tool embodiment.

Another feature is that upon shearing of the pulling tool, the dogs are forced into the release mode by the angle on the top of the dogs being pushed up against the top shoulder in the windows and the mid section of the dog's inner surface being pushed out of the angled surface at the bottom of the core. There is a 1.5 degree difference between the longer surface of the mandrel and the upper inside surface of the two member dogs which facilitates member dog release from the object. The angle at the bottom of the mandrel is responsible for lifting the dogs and pushing the dog legs outward. Another feature is that the tool is designed so that after shearing, the two sheared ends of the pin can not be accidentally lost while pulling out of the well. Yet another feature is there are no externally visible springs that could hang up within the well bore and be torn off, leaving debris that can interfere with subsequent operations.

BRIEF DESCRIPTION OF THE DRAWINGS

FIG. 8 illustrated the sequential step of shearing the shear pin in the novel apparatus.

FIG. 9 illustrates the next sequential step wherein the shear pin has sheared.

FIG. 10 illustrates the sequential step of retrieving the novel apparatus from the well.

DETAILED DESCRIPTION OF THE PREFERRED EMBODIMENTS

Figure 1:
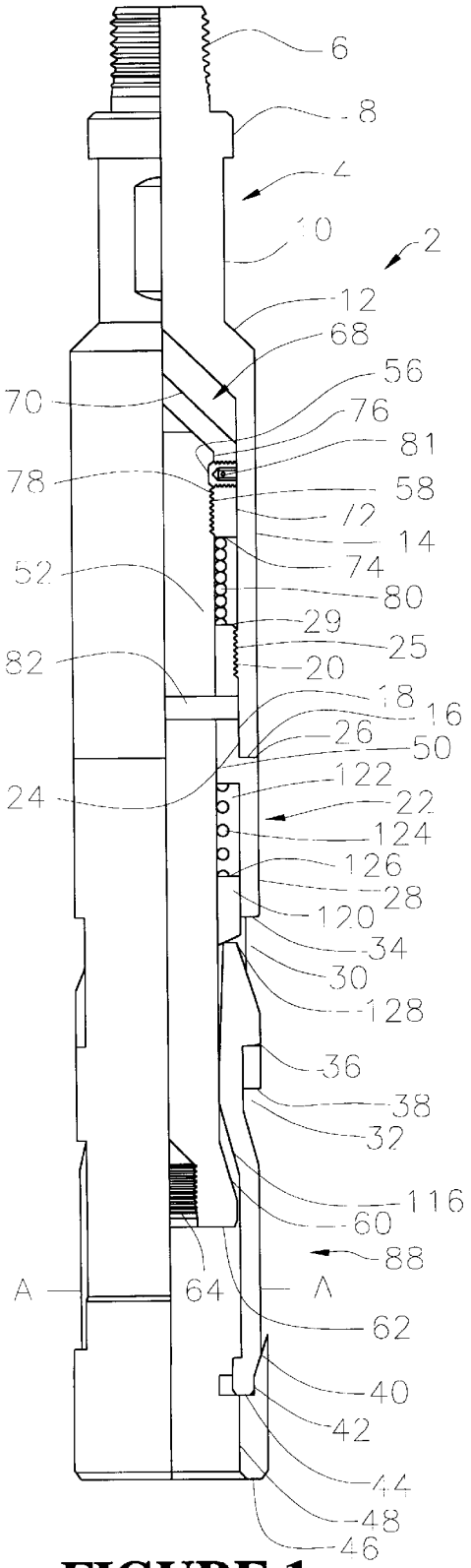
FIG. 1 is a partial cross-sectional view of the first embodiment of the novel apparatus of the jar down shear configuration depicted in the pulling mode.

Referring now to FIG. 1, a partial cross-sectional view of the first embodiment of the novel apparatus 2 will not be described. In the embodiment of FIG. 1, the apparatus 2 is shown in the pulling mode. This embodiment is also referred to as the jar down shear configuration. The apparatus 2 will generally include a tubular housing 4 that has a means for connecting to a work string. In the embodiments shown, the connection means comprises an external thread means 6 that extends to a first shoulder 8 which in turn extends to a generally first cylindrical surface 10. The first cylindrical surface extends to the chamfered surface 12 that in turn extends to the second cylindrical surface 14, with the surface 14 terminating at the end 16 . Extending radially inward of the end 16 is the internal bore 18, with the bore 18 having internal thread means 20 .

A skirt 22 is also provided. The skirt contains a first outer cylindrical surface 24 and thread means 2that extends to a shoulder 26, with the shoulder 26 stretching to the second outer cylindrical surface 28 and an end 29. The skirt 22 will have a first window 30 (also referred to as an opening) and a second window 32 (also referred to as an opening). The window 30 contains the shoulders 34, 36 and the window 32 contains the shoulders 38, 40. The shoulder 40 contains a generally angled surface 40 that extends to the inner bore surface 42 which in turn concludes at the radial shoulder 44. The skirt 22 concludes at the end 46. The skirt 22 contains a first inner bore 48 and a second inner bore 50.

The apparatus 2 also contains the core member, seen generally at 52. The core member 52 is generally cylindrical and contains an outer cylindrical surface 54 that contains an indention 56 that forms circumferential recess to receive set screw 8 1. The outer cylindrical surface 54 also contains the external thread means 58. The second end of the core member 52 contains an angled surface 60, with the angled surface 60 conducting at the end 62. Extending radially inward is the bore 64 that contains internal thread means 66.

The core member 52 will be operatively associated with the core nut 68. As depicted in FIG. 1, the core nut 68 will be threadedly connected to core member 52. The core nut 68 will contain the conical surface 70 that extends to the cylindrical outer surface 72 that terminates at the end 74. The end 74 continues radially inward to the inner bore 76 that contains the internal threads 78 that will cooperate with the thread means 58. Thus, a chamber is formed between the cooperation between the core nut end 74 and the skirt 22, with a spring means 80 being disposed therein. The spring means 80 will be a compression type of spring which in the embodiment seen in FIG. 1 is in compression. In the embodiment shown, the core nut 68 also contains an aperture for placement of a set screw 81. The set screw 81 will be configured to cooperate with the indentation 56 which aids in the attachment of the core nut 68 to the core member 52.

A means for connecting the core 52 to the skirt 22 is also provided. The connecting means is, in the preferred embodiment, a shear pin 82. The shear pin 82 is fitted in an aperture located within the skirt 22 and an aperture located within the core 52. The shear pin 82 is generally a 5/16 inch diameter shear pin. This diameter shear pin allows for a significantly greater pull force to be exerted to the apparatus 2 before shearing, as will be explained in greater detail later in the application.

The dog member 88 will now be described. In the embodiment shown, a first dog member 88 and second dog member 89 is depicted, with the two dogs being similar in construction. As those of ordinary skill in the art will appreciate, pulling tools generally contain at least two dog members. The dog member 88 contains a first end 90 that is angled in the preferred embodiment at an angle of 66 degrees. The first end 90 extends to the chamfered surface 92 which in turn extends to the outer surface 94. The outer surface 94 terminates at the radial shoulder 96, with the radial shoulder 96 extending to the outer surface 98. As seen in FIG. 1, the radial shoulder 96 cooperates with shoulder 36 as a load surface.

The outer surface 98 extends to an angled leg portion 100, with the angled leg portion 100 terminating at the outer surface 102. The outer surface 102 concludes at the angled surface 104, with the angled surface 104 cooperating and abutting with the shoulder 40. The angled surface 104 extends to the outer surface 106 which in turn extends to the end 108, with the end cooperating and abutting the radial surface 44. Extending radially inward is the inner surface 110 that stretches to the radial shoulder 112 which in turn concludes at the inner surface 114. The inner surface extends to the angled inner surface 116 which in turn extends to the inner surface 118.

The apparatus 2 also includes a retaining ring 120, with the retaining ring 120 being disposed about the core member 52. The retaining ring also cooperates and is disposed within the inner bore 48 of the skirt 22 such that a spring chamber 122 is formed. The spring chamber 122 will have the compression spring 124 disposed therein. The retaining ring 120 contains a first end 126 and a second angled end 128, with the angled end 128 being complementary with the end 90 of the dog 88. The compression spring 124 will bias the end 126 while the other end of the spring 124 acts against the end of the spring chamber 122.

Figure 3:
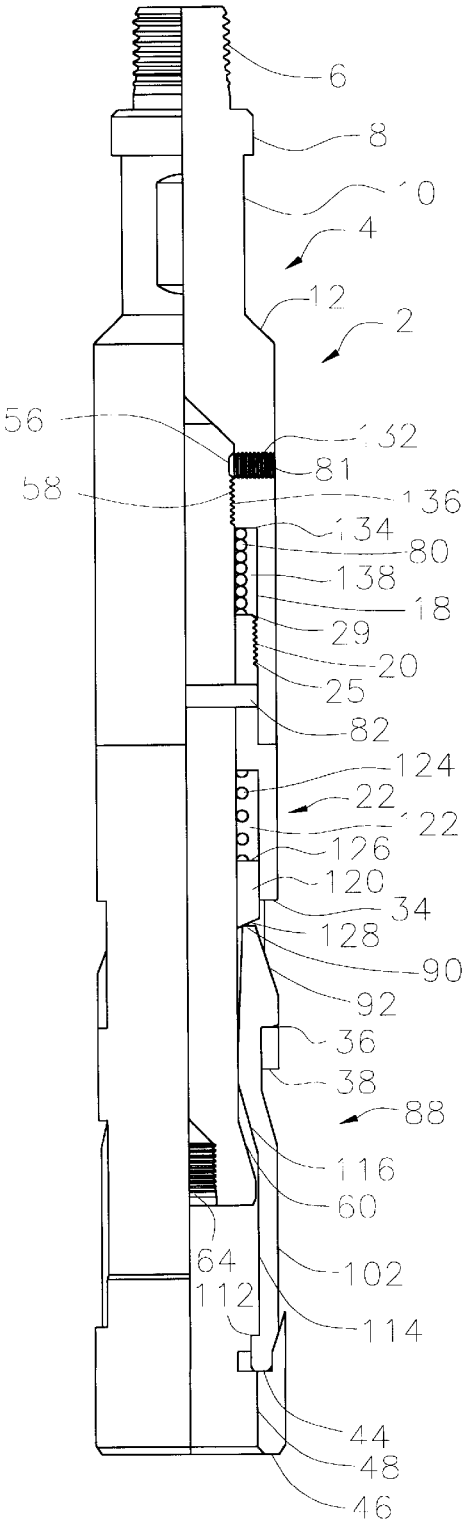
FIG. 3 is a partial cross-sectional view of the second embodiment of the novel of the jar up shear configuration apparatus depicted in the pulling mode.

Referring now to FIG. 3, a partial cross-section of a second embodiment of the present invention will now be described. This embodiment is also referred to as the jar up shear configuration. It should be noted that like numbers appearing in the various figures refer to like components. In the embodiment of FIG. 3, the tubular housing 4 has contained therein the aperture 132 for placement of the set screw 81. The internal bore 18 extends to a shoulder 134 that in turn stretches to internal thread means 136. The internal thread means 136 cooperate with the external thread means 58 of the core 52.

Figure 2:
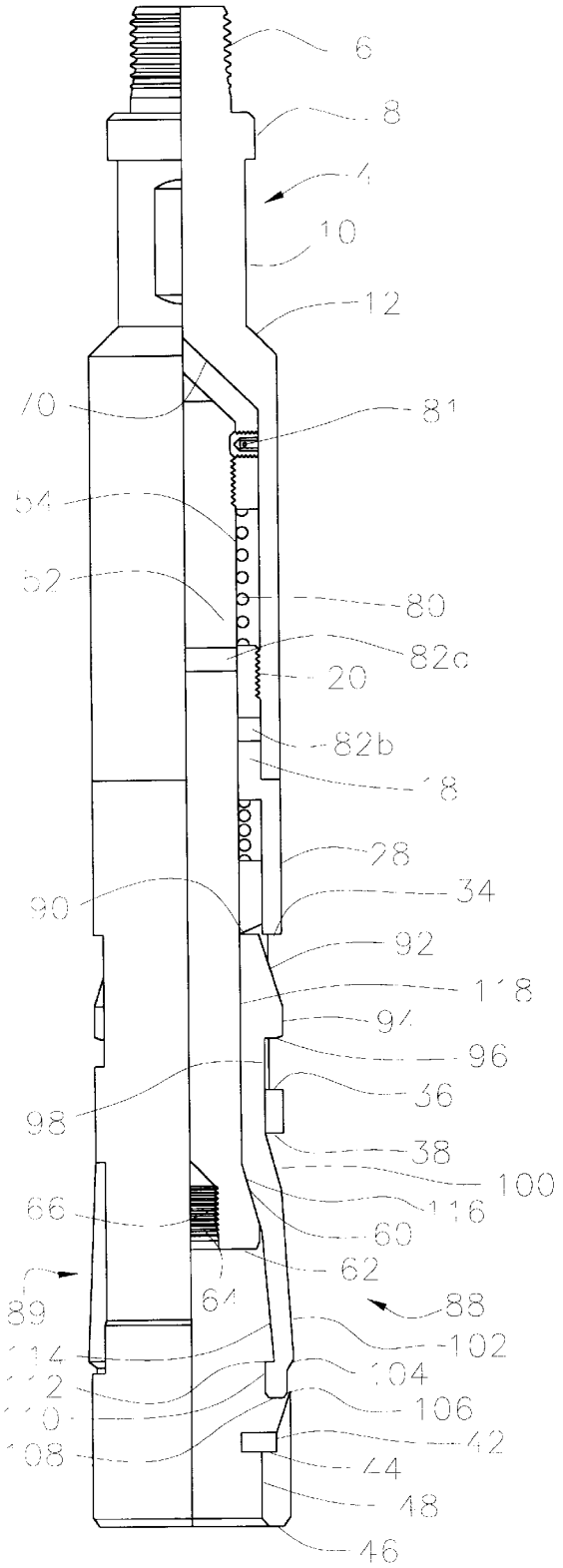
FIG. 2 is a partial cross-sectional view of the embodiment of FIG. 1 depicted in the sheared mode.

As depicted in FIG. 3, the skirt 22 is identical to the skirt 22 illustrated in FIGS. 1 and 2. Note that the external thread means 2do not engage with any thread means of the tubular housing 4, instead, the skirt 22 is slidably received within the internal bore 18 of the tubular housing 4. The skirt similarly contains the first window 30 and the second window 32 that allows the cooperation of the dog members 88 for latching and unlatching from the fishing neck of the object to be retrieved from the well.

Figure 4:
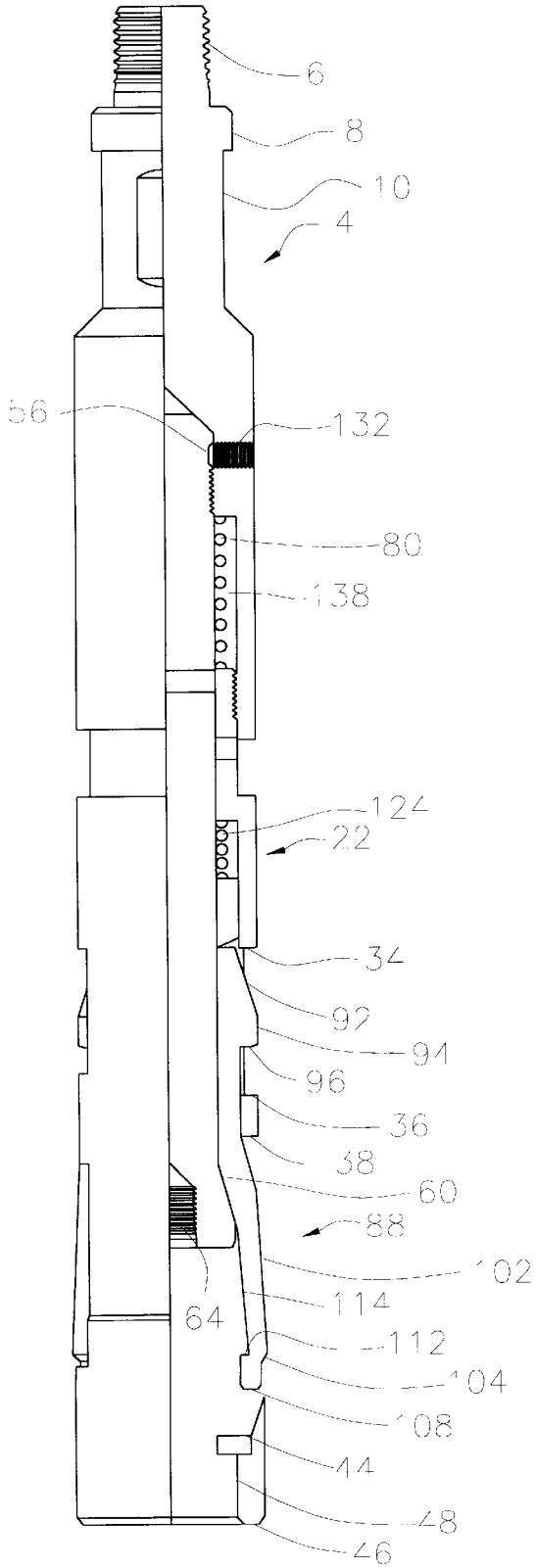
FIG. 4 is a partial cross-sectional view of the embodiment of FIG. 3 depicted in the sheared mode.

A spring chamber 138 is formed from the configuration of the shoulder 134, the outer surface 54 and skirt end 29. The compression spring 82 is therefore disposed within the spring chamber 138. The core 52 is selectively connected to the skirt 22 via the shear pin 82 which is fitted into an aperture of the skirt 22 and an aperture of the core 52. The retaining ring 120 is also provided, with the compression spring 124 acting to bias the retaining ring into engagement with the dog member 88. FIG. 4 is included to show a partial cross-sectional view of the embodiment of FIG. 3 depicted in the sheared mode.

Figure 5:
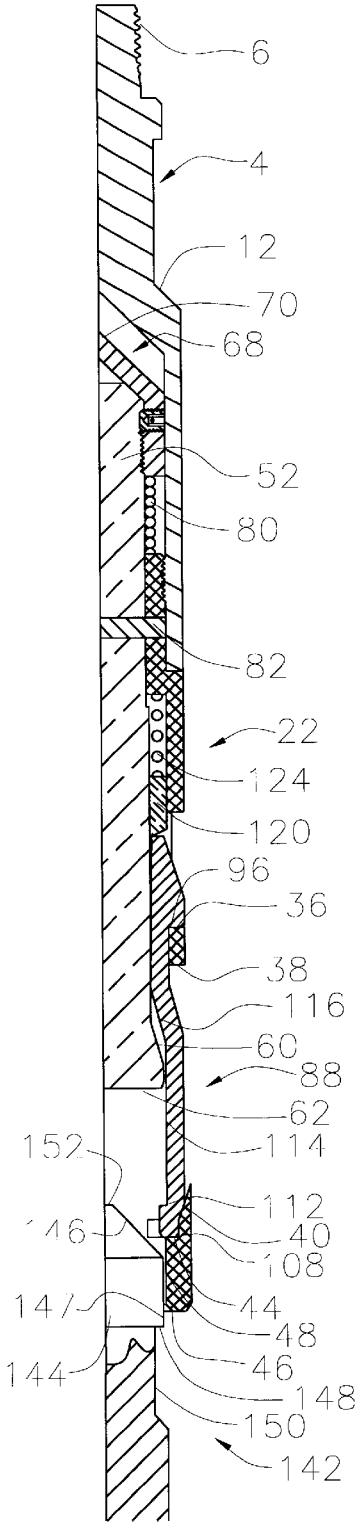
FIG. 5 is the embodiment of FIG. 1 illustrating the novel apparatus approaching the fishing neck of the object to be pulled from the well.
Figure 11:
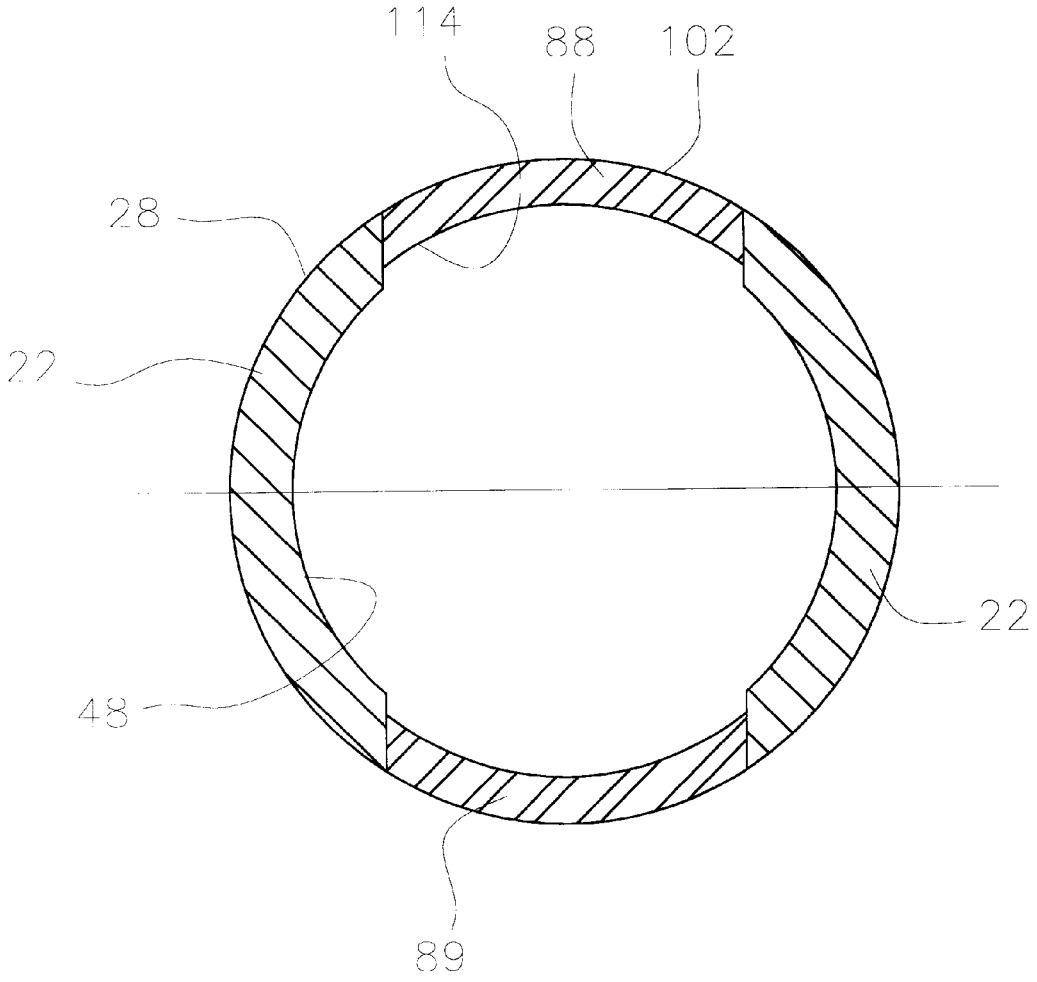
FIG. 11 is a cross-sectional area taken along line A—A of FIG. 1.

Reference is now made to FIGS. 5, 6, 7, 8, 9, 10 which is the sequence showing the novel apparatus 2 (of FIG. 1 ) approaching the fish, latching on to the fish, and then shearing off of the fish. With particular reference to FIG. 5, FIG. 5 depicts novel apparatus 2 approaching the fishing neck 144 of the fish 142 that will be pulled from the well. Thus, the inner bore 48 with skirt 22 will be lowered over the fish, and in particular the conical surface 146 and the first cylindrical surface 147. As depicted in FIG. 5, the skirt, and in particular the inner bore 48, will be allowed passage over the cylindrical surface 147. Note that compression spring 124 acts against retaining ring 120 so that the dog member 88 acts against shoulder 38 as well as 44 of the skirt.

Figure 6:
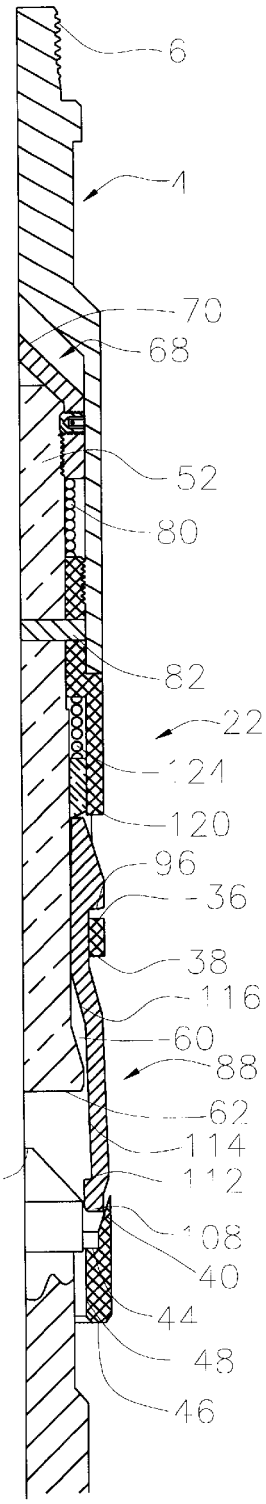
FIG. 6 is the embodiment of FIG. 5 illustrating the sequential step of latching the novel apparatus onto the fishing neck of the object.

With reference to FIG. 6, the next sequential step depicting the novel apparatus 2 latching onto the fishing neck 144 will now be described. Thus, as the apparatus 2 is lowered via the work string, the conical surface 146 will act against the end 108 of the dog member 88 thereby pushing the dog member 88 upward. This in turn causes the dog member 88 to act against the retaining member 120 with the retaining member 120 thereby compressing spring 124 as shown in FIG. 6. Further downward movement causes the dog member to become situated as shown in FIG.6 wherein end 108 abuts shoulder 40.

Figure 7:
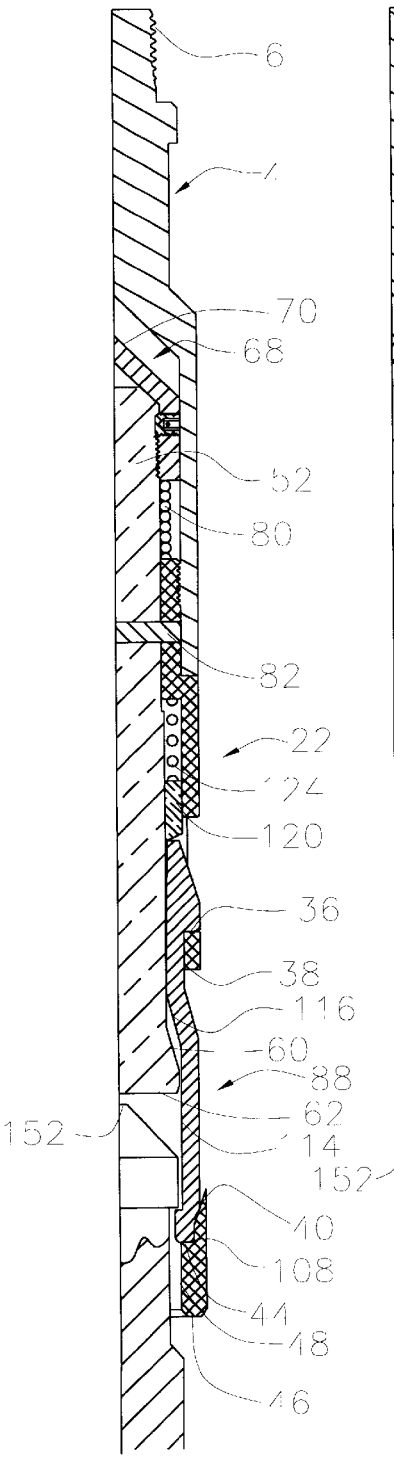
FIG. 7 illustrating the sequential step of latching onto the fishing neck of the object to be pulled from the well.

Next, FIG. 7 shows the following sequential step wherein the apparatus 2 is latched onto the fishing neck 144 of fish 142. In particular, once the skirt 22 has been lowered to the appropriate depth, the spring 124 will bias the dog member 88 downward, thereby allowing the radial shoulder 112 to engage the radial shoulder 148 of the fish 142 as depicted in FIG. 7. Note that the dog member end 108 abuts radial surface 44 of the skirt 22. In normal operation, the operator can begin to pull on the fish since the dog members, and in particular the shoulders 112, are latched on to the fish.

Due to the novel design, the dogs 88 are supported at shoulder 36 and end 44. The two point support distributes the pulling load to two places on the skirt 22. In other words, by transferring the upward force from the first end and second end of the dog 88 to the first shoulder and the second shoulder of the skirt, this upward force is distributed to the first point (shoulder 36) and second point (shoulder 44). In experimental tests, it has been found in a pull test that the novel design allows a pull of over 60,000 pounds. More particularly, the first pull test resulted in a pull of approximately 62,250 pounds before the dogs were damaged (sheared), a second pull test resulted in a pull of approximately 60,500 pounds before the dog were damaged (sheared) and a third pull test resulted in a pull of approximately 64,650 pounds before the dogs were damaged (sheared). In these test, the skirt proved to be undamaged and capable of further use attesting to the novel distribution of the pull load about the skirt.

Thus, by allowing the force to be distributed to two places in the skirt, it is possible to pull a much greater force than ever before existed in prior art pulling tools. As well bores become more deviated and skewed, it is very important for operators to have the ability to pull this increased load in order to unseat any previously set device and/or fish. It should be noted that the embodiment of FIGS. 3 and 4 will distribute the forces about the skirt in the same manner.

In the event that the operator cannot pull the object from the well, it becomes necessary to shear the shear pin 82 and retrieve the novel apparatus 2 without the fish 142, as will be appreciated by those of ordinary skill in the art. This is accomplished by the ensuing sequential step shown in FIG. 8 of shearing the shear pin 82. Thus, the operator will lower the apparatus via the work string. This in turn will cause the end 62 of the core 52 to abut the top end 152 of the fish 142 as shown in FIG. 8. Further downward movement allows the skirt end 46 to proceed downward relative to the cylindrical surface 150 of the fish. Once the appropriate amount of downward jarring force has been applied to the apparatus 2, shear pin 82 will shear. The shear pin shears to segments 82*a* and 82*b*. Please note that in the design of the preferred embodiment, the shear pins 82*a*, 82*b* do not drop off into the well bore, but rather are retained within the core and the skirt as shown.

As depicted in FIG. 9, which is the next sequential step after the shear pin 82 has been sheared, the spring 80 can now bias upwards the core nut 68. By biasing the core nut 68 upwards along with the core 52, the angle surface 60 of the core 52 will engage and cooperate the angled inner surface 116 of the dog members 88 as depicted in FIG. 9. This engagement of surface 60 with surface 116 expands the dog member outward such that the surface 106 of the dog 88 no longer engages the inner bore surface 42 of the skirt. This expansion will allow the radial shoulder 112 to clear the radial shoulder 148 of the fish 142.

The last sequence is shown in FIG. 10. This is the sequence where in the novel apparatus 2 is being retrieved from the well. Note that spring means 80 has biased the core nut 68 and core 52 upwards. Angled surface 60 and angled surface 116 are cooperating thereby expanding the dog member 88, and in particular the radial shoulder 112 past the radial shoulder 148. It should be noted that once the shear pin 82 is sheared, the spring 80 will overcome spring 124 thereby allowing the disposition of the core 52 to dog 88 as shown in FIG. 9 and FIG. 10.

In operation of the second embodiment illustrated in FIG. 3, an upward pull is exerted on the work string, such as wire line, coiled tubing or electric line. The upward pull is applied directly through the thread connection 6 and the thread connections 58/136 of the core 52 to the tubular housing 4. As the pulling force is exerted, the force is transmitted to the shear pin 82, to the skirt 22, then to the dogs by the load surfaces 36/44 and to the hooked bottom 112 of the dogs 88/89. It should be noted that the novel distribution of forces is as mentioned earlier with reference to the embodiment of FIGS. 1 and 2.

After latching onto a fishing neck (contained on the object being retrieved from the well), upward jarring is transmitted through the shear pin 82 to the dogs. After a period of jarring, the operator will find it necessary to shear the pin 82 in order to pull out of the well. Once the sufficient amount of upward jarring force is applied, the pin will shear into the 82*a* and 82*b*, as seen in FIG. 4, between the core 52 and the skirt 22 allowing the core 52 to move upward which in turn pulls the dogs 88 up causing the hooked ends 112 to move up and out, thereby releasing from the fishing neck. Note that the pins 82*a*, 82*b* are blocked from falling out of the apparatus 2.

Therefore, in the embodiments thus presented, the novel apparatus 2 will stand significantly more pull and strain than prior art pulling tools. One of the reasons for this increase in pull is the support provided by the dogs 88/89. The dogs 88/89 are supported at points 36 and 44 whereas prior art devices are supported at only one point i.e. on only one shoulder. The two point support distributes the puling load to two places on the skirt 22. Further, the dogs 88/89 are fabricated from carbon or alloy steel. The invention herein described is convertible from a jar up type of tool to ajar down type of tool by simply switching the upper tubular housing and providing the core nut.

It should also be noted that it is possible to bore a fluid passage through the center of the housing 4 and core 52 so that a fluid can be pumped therethrough. In this embodiment, the operator can pump a well fluid, drill fluid, completion fluid, etc. through the bore, The ability to pump through may be beneficial in certain circumstances such as a fishing job.

Changes and modifications in the specifically described embodiments can be carried out without departing from the scope of the invention which is intended to be limited only by the scope of the appended claims.

I claim:

1. A device for retrieving an object from a well bore comprising:

a tubular housing having an outer portion and inner portion;

a skirt attached to said tubular housing, said skirt having an inner bore and wherein said skirt contains a first window and a second window, said first window having a first shoulder thereon and said second window having a second shoulder thereon;

a core being disposed within said inner bore of said skirt, said core being connected to said skirt with a shear pin and wherein said core has a first end and a second end, and wherein said second end contains an angled shoulder;

a dog member disposed about said core, said dog member having a first end that cooperates with said first shoulder of said first window and a second end that cooperates with said second shoulder of said second window wherein said dog member contains an angled leg that is configured to cooperate with said angled shoulder of said core;

a core nut attached to said first end of said core, said core nut cooperating with said inner portion of said tubular housing to form a first spring chamber;

a first spring disposed within said first spring chamber, said first spring biasing a first end of said core nut in an upward direction so that as said shear pin is sheared, said core is slidably received within said inner portion of said tubular housing.

2. The device of claim 1 wherein said inner bore of said skirt and said core cooperate to form a second spring chamber, and the device further comprises:

a retaining ring disposed about said core and positioned within said second spring chamber biasing a shoulder of said skirt and a first end of said retaining ring so that said first and said second and of said dog member is urged against said first shoulder of said first window and said second shoulder of said second window.

3. A method of releasing a device that is attached to an object within a well bore, the device being attached to a work string, the device comprising: a tubular housing having an outer portion and an inner portion; a skirt attached to said tubular housing, said skirt having an inner bore and wherein said skirt contains a first window and a second window therein, said first window having a first shoulder thereon and said second window having a second shoulder thereon; a core being disposed within said inner bore of said skirt, said core being connected to said skirt with a pin, wherein said core has a first end and a second end, and wherein said second end contains an angled shoulder; a dog member disposed about said core member, said dog member having a first end that cooperates with said first window and a second end that cooperates with said second window; the method comprising:

pulling upward on the work string so that an upward force is created;

transferring said upward force to said tubular housing;

transferring said upward force from said first end and said second end of said dog member to said first shoulder and said second shoulder in order to distribute said upward force in said skirt to the first shoulder and to the second shoulder;

providing a downward jarring force to said tubular housing;

contacting a first end of said core against the object;

shearing said pin so that said core is slidably disposed within the inner portion of said tubular housing;

expanding a core spring located in a first spring chamber;

lifting the core upward via said spring;

engaging the angled core end located on said core with an angled surface of said dog member;

lifting said dog member;

expanding said dog member outward into said first window;

biasing said core with said core spring located within said spring chamber;

moving said core upward within said inner portion;

releasing the device from the object;

pulling the work string from the well bore.

4. An apparatus run on a work string into a well bore, the apparatus comprising:

an elongated housing having an internal chamber, said housing having means for connecting to the work string;

a skirt attached to said housing, said skirt having inner portion and wherein said skirt contains a first window and a second window therein, said first window having a first shoulder thereon and said second window having a second shoulder thereon;

a mandrel disposed within said inner portion and wherein said mandrel has a first end and a second end, and wherein said second end contains an angled shoulder;

a dog member disposed about said mandrel, said dog member having a first surface that cooperates with said first shoulder and a second surface that cooperates with said second shoulder wherein said dog member contains an angled leg that is configured to cooperate with said angled shoulder of said mandrel;

means, disposed about said mandrel, for biasing said dog member in a downward direction;

a shear pin adapted for connecting said skirt with said mandrel; a core nut attached to a first end of said mandrel, said core nut coonerating with said internal chamber of said housing to form a first spring chamber;

a first spring disposed within said first spring chamber, said first spring acting to create a force against said core nut in an upward direction;

and wherein when said shear pin is sheared, said mandrel is slidably received within said inner chamber of said housing.

5. The apparatus of claim 4 wherein said biasing means comprises:

a second spring;

a retaining ring disposed about said mandrel and cooperating with said spring to urge said dog member into engagement with said first shoulder and said second shoulder.

* * * * *